US012509322B2

(12) United States Patent
Nichols et al.

(10) Patent No.: US 12,509,322 B2
(45) Date of Patent: Dec. 30, 2025

(54) REEL WITH ROLLED CORE

(71) Applicant: Vandor Corporation, Richmond, IN (US)

(72) Inventors: Christopher Nichols, Englewood, OH (US); Adrienne Cowen, Richmond, IN (US); Richard Brown, Richmond, IN (US); Jeffrey Creigmile, Centerville, IN (US)

(73) Assignee: Vandor Corporation, Richmond, IN (US)

( * ) Notice: Subject to any disclaimer, the term of this patent is extended or adjusted under 35 U.S.C. 154(b) by 435 days.

(21) Appl. No.: 18/148,175

(22) Filed: Dec. 29, 2022

(65) Prior Publication Data

US 2023/0219784 A1 Jul. 13, 2023

Related U.S. Application Data

(60) Provisional application No. 63/294,723, filed on Dec. 29, 2021.

(51) Int. Cl.
*B65H 75/22* (2006.01)

(52) U.S. Cl.
CPC ..... *B65H 75/2218* (2021.05); *B65H 75/2245* (2021.05); *B65H 75/229* (2021.05)

(58) Field of Classification Search
USPC ..... 242/614.1
See application file for complete search history.

(56) References Cited

U.S. PATENT DOCUMENTS 1,565,655 A * 12/1925 Georges ..... G03B 17/30 242/118.8
2,177,152 A * 10/1939 Ross ..... G03B 21/321 242/585
2,380,641 A * 7/1945 Freiler ..... B65H 75/14 242/608.2
2,799,458 A * 7/1957 Nye ..... G03B 21/321 D8/358
3,876,073 A * 4/1975 Herbetko ..... B65H 75/14 206/400
3,958,775 A * 5/1976 Liga ..... B65H 75/14 D8/358
4,244,538 A * 1/1981 Theros ..... B65H 75/14 242/118.8

(Continued)

*Primary Examiner* — William A. Rivera
(74) *Attorney, Agent, or Firm* — Maginot, Moore & Beck LLP

(57) ABSTRACT

A kit for assembly into at least a first reel includes a core and two flanges. The core has a substantially rectangular main body having opposing first and second axially extending edges and opposing first and second end edges extending between the first and second axially extending edges. The core also includes a first set of interlocking teeth on the first axially extending edge, and a first set of first connecting tabs on the first end edge. The main body is configured to be deformed or rolled into a cylinder in which the first set of interlocking teeth engage connecting features of the second axially extending edge. The first flange has an annulus and at least one axially extending rib or rim. The annulus includes receptacles for receiving and operably coupling to the first set of connecting tabs. The second flange is configured to couple to the core.

19 Claims, 11 Drawing Sheets

(56) References Cited

U.S. PATENT DOCUMENTS 4,620,676 A * 11/1986 Missalla ..... B65H 75/2254 242/604
4,747,561 A * 5/1988 Sweeny ..... B65H 75/406 242/608.5
5,513,819 A * 5/1996 Orange ..... B65H 75/2209 242/610.2
5,577,344 A * 11/1996 Zaremba ..... A47G 7/041 108/150
5,735,483 A * 4/1998 Bierlein ..... B65H 75/2245 242/118.8
5,791,590 A * 8/1998 Zuk ..... B65H 75/229 242/610.6
5,934,606 A * 8/1999 Guild ..... B65H 75/2263 242/603
6,712,309 B1 * 3/2004 Martinez ..... B65H 75/04 242/537
6,868,969 B2 * 3/2005 Gosis ..... B65D 85/54 206/592
9,555,999 B2 * 1/2017 Smith ..... B65H 75/229
9,556,000 B2 * 1/2017 Carman ..... B65H 75/14
2008/0283649 A1 * 11/2008 Anger ..... B65H 75/14 242/370
2010/0025521 A1 * 2/2010 Snitselaar ..... B65H 75/2245 242/608.2
2011/0101153 A1 * 5/2011 Brennaman ..... B65H 75/2236 242/608
2014/0239112 A1 * 8/2014 Mills ..... B65H 75/2209 242/407.1
2020/0407189 A1 * 12/2020 Thakare ..... B65H 75/242
2021/0300718 A1 * 9/2021 Thakare ..... B65H 49/205
2023/0219782 A1 * 7/2023 Thakare ..... B65H 75/2416 242/578.2
2024/0400345 A1 * 12/2024 Brown ..... B65H 75/2218

* cited by examiner

REEL WITH ROLLED CORE

This application claims the benefit of U.S. provisional patent application Ser. No. 63/294,723, filed Dec. 29, 2021, which is incorporated herein by reference.

TECHNICAL FIELD

The present invention relates generally to spools and reels.

BACKGROUND

The transport and use of cable, wire, optical fiber, and other wound media typically involves winding the media on a spool or reel. Typical reels for construction purposes can have a traverse length (or axial height) of any length, and any flange diameter. Reels generally consist of a core around which the wound media is wrapped, and two flanges at opposite ends of the core. Such reels can be made of wood, but are often constructed of plastic and/or corrugated paper to obtain better strength-to-weight ratios.

In addition to material cost and weight, a cost (both financial and environmental) associated with reels is the shipment of empty reels. For example, a wire company often obtains reels from another source, which are shipped to the wire company to be loaded with wire. An assembled, empty reel occupies a significant amount of space in shipment, resulting in inefficiencies. As a consequence, it is known to ship flanges and cores of reels separately for assembly at their destination. This reduces the three-dimensional footprint of each reel, thereby increasing the number of reels that may be shipped in the same space.

Nevertheless, a reduction in shipping costs is desirable, as it represents a non-trivial proportion of the cost of empty reels.

SUMMARY

At least some embodiments of the present invention addresses the above-stated needs, as well as others, by providing a reel having a rolled core and a flanges that interconnect with the rolled core. The rolled core may be shipped flat, and assembled onto the flanges another destination, such as the destination at which the reel will be loaded.

A first embodiment is a kit configured for assembly into at least a first reel that includes a core and two flanges. The core has a substantially rectangular main body having opposing first and second axially extending edges and opposing first and second end edges extending between the first and second axially extending edges. The core also includes a first set of interlocking teeth on the first axially extending edge, and a first set of first connecting tabs on the first end edge. The main body is configured to be deformed or rolled into a cylinder in which the first set of interlocking teeth engage connecting features of the second axially extending edge. The first flange has an annulus and at least one axially extending rib or rim. The annulus includes receptacles for receiving and operably coupling to the first set of connecting tabs. The second flange is configured to couple to the core.

Another embodiment is a reel formed from the kit described above.

The above-described features and advantages, as well as others, will become more readily apparent to those of ordinary skill in the art by reference to the following detailed description and accompanying drawings.

DETAILED DESCRIPTION

Figure 1:
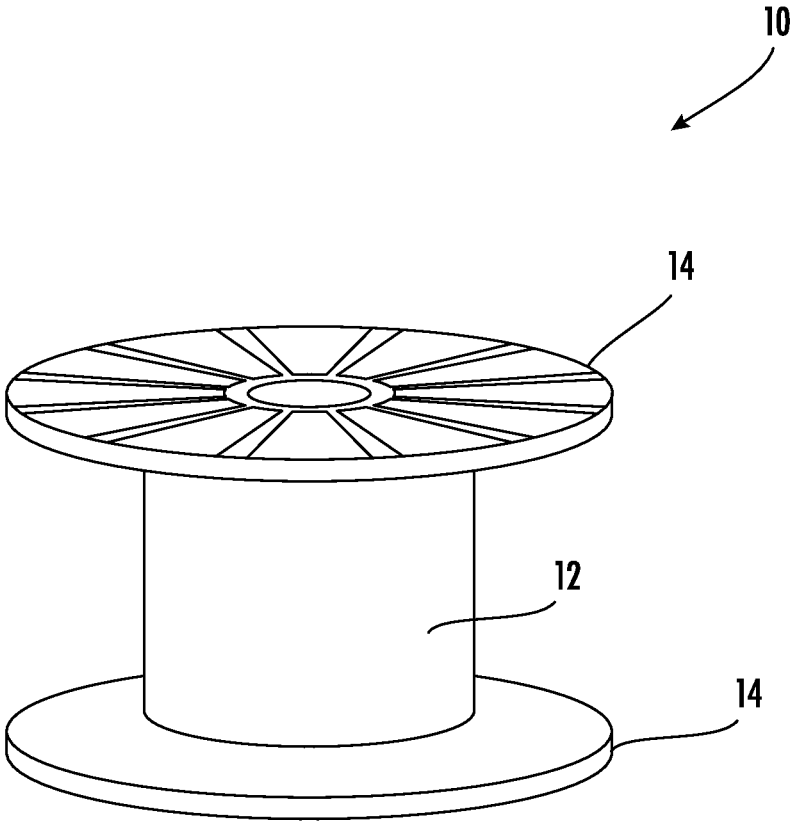
FIG. 1 shows a perspective representative view of a reel according to a first embodiment.

FIG. 1 shows a perspective representative view of a reel 10 according to a first embodiment. In general, the reel 10 includes a core 12 disposed and affixed between two flanges 14. In this embodiment, the core 12 and flanges 14 polyethylene, polypropylene or similar plastic material. The core 12 formed from a rolled sheet or blank formed of plastic, and the flanges 14 are preferably formed from injection molded plastic. In use, wound flexible media such as wire, cable, electrical part tapes, optical fiber and the like is wound about the core 12, and retained axially by the flanges 14.

Figure 2A:
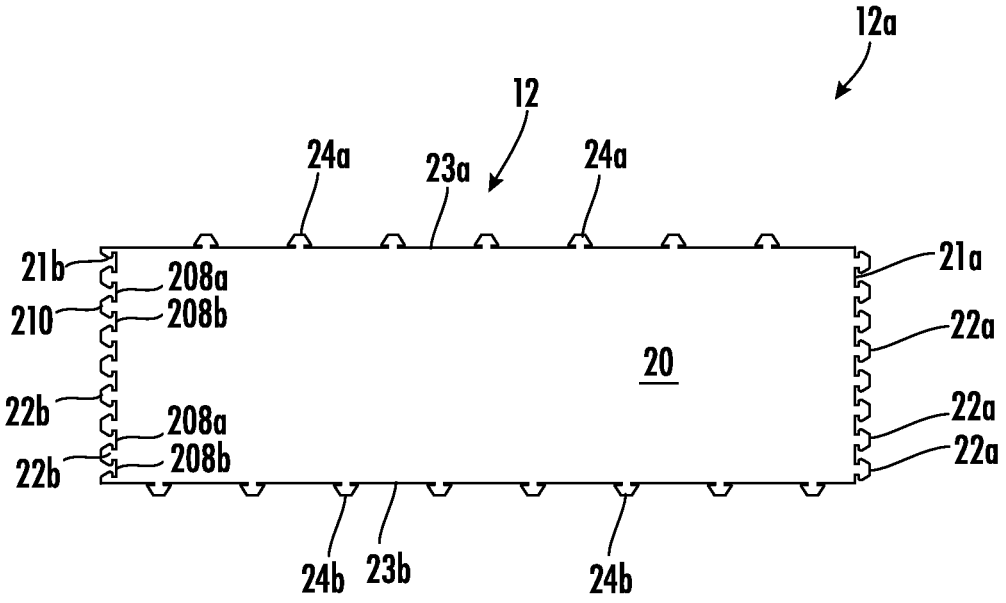
FIG. 2A shows a top plan view of the core of the reel of FIG. 1 in its unrolled state, as a blank.
Figure 2B:
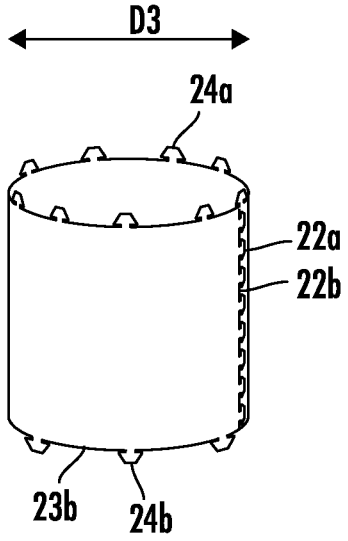
FIG. 2B shows a perspective view of the core of the reel of FIG. 1 in its rolled state.

FIG. 2A shows a top plan view of the core 12 in its unrolled state, also referred to herein as a blank 12*a*. FIG. 2B shows a perspective view of the core 12 in its rolled state, apart from the flanges. The core 12 includes a main body 20, interlocking teeth 22*a*, 22*b*, and connecting tabs 24*a*, 24*b*. The main body 20 in the blank 12*a* has a substantially rectangular shape, and in this embodiment is a flexible, flat sheet of plastic. The main body 20 in the rolled core 12 of FIG. 2B has the shape of a cylinder.

The main body 20 includes a first axially extending edge 21*a* and an opposite axially extending edge 21*b*. The main body 20 further includes a first end edge 23*a* and an opposite second end edge 23*b*, each of which extending between the first and second axially extending edges 21*a*, 21*b* to form the substantially rectangular shape of the main body 20 in the blank 12*a*.

The interlocking teeth 22*a* and 22*b* extend from opposite longitudinal ends of the main body 20. More specifically, the interlocking teeth 22*a* extend from the first axially extending edge 21*a*, and the interlocking teeth 22*b* extend from the second axially extending edge 21*b*. The connecting tabs 24*a*, 24*b* extend from opposite axial ends of the main body 20. More specifically, the connecting tabs 24*a* extend from the first end edge 23*a*, and the connecting tabs 24*b* extend from the second end edge 23*b*. The main body 20 is configured to be deformed or rolled into a cylinder as shown in FIGS. 1 and 2B, and in which the interlocking teeth 22*a*, 22*b* engage each other.

When the main body 20 is rolled into the cylinder, the connecting tabs 24*a* extend from the axial top of the main body 20, and the connecting tabs extend from the axial bottom of the main body 20, and are configured to be received by receptacles in the flanges 14, discussed further below.

Figure 2D:
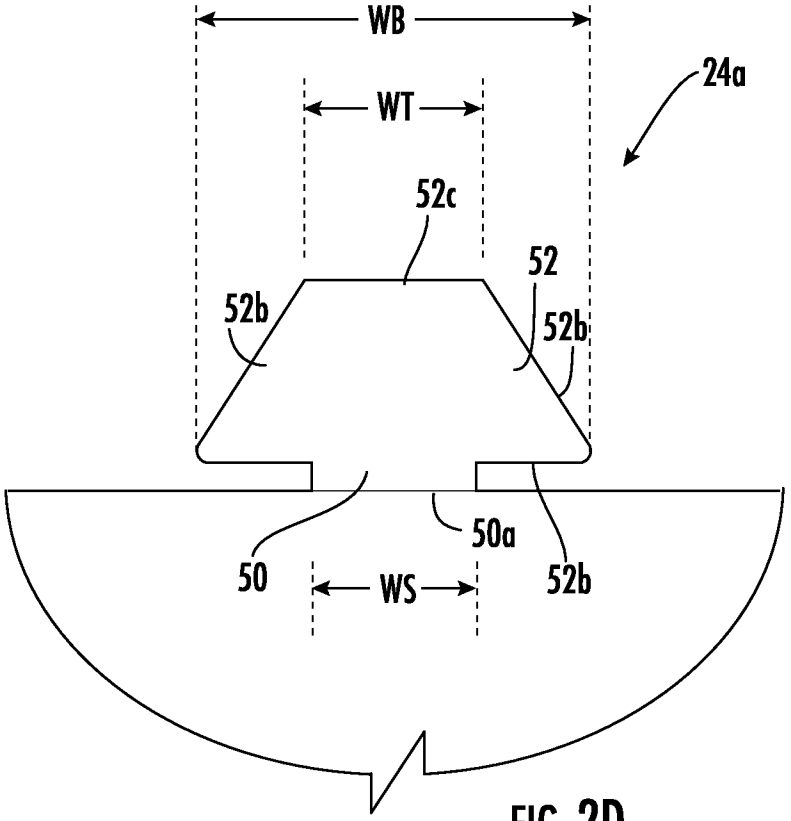
FIG. 2D shows an enlarged fragmentary view of the core blank of FIG. 2A showing another small portion of the main body and one of the connecting tabs of the core.
Figure 2C:
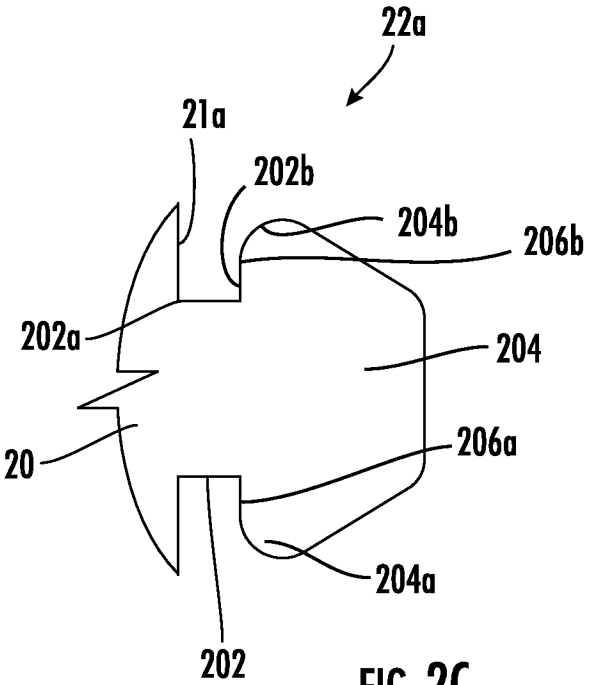
FIG. 2C shows an enlarged fragmentary view of the core blank of FIG. 2A showing a small portion of the main body of the core and one of the interlocking teeth of the core.

FIG. 2C shows an enlarged fragmentary view of the core 12 showing a small portion of the main body 20 and one of the interlocking teeth 22*a*. The interlocking teeth 22*b* in this embodiment have a substantially mirror-image shape of the interlocking tooth 22*a*. As shown in FIG. 2C, the interlocking tooth 22*a* has a stem 202 having a first end 202*a* coupled to (and seamlessly formed with in this embodiment) the main body 20, and namely, the first axially extending edge 21*a*. The stem 202 also includes a second end 202*b* couple to a head 204. The head in this embodiment resembles a trapezoid centered on the stem 202, and having rounded lower corners 204*a*, 204*b*. The head 204 includes lower ledges 206*a*, 206*b* that extend from the stem 202 to, respectively, the lower corners 204*a*, 204*b*. As shown in FIG. 2A, the teeth 22*b* also include corresponding heads 210 and lower ledges 208*a*, 208*b*.

The interlocking teeth 22*a* and configured to be interlaced with and coupled to the interlocking teeth 22*b* in rolled core 12, as shown in FIG. 2B. In general, when the main body is rolled into a cylinder the interlocking teeth 22*b* and interlocking teeth 22*a* are advanced each other, past the respective opposite axially extending adage 21*a*, 21*b* and at least partially against a side of the main body 20. Ideally, each adjacent interlocking tooth 22*a* is disposed on alternating sides of the main body 20, and each adjacent interlocking tooth 22*b* is disposed on alternating sides of the main body 20. As a result, slight plastic deformation in opposite directions of each of the interlocking teeth 22*a*, 22*b* causes the ledges 208*a*, 208*b* (see FIG. 1) of the interlocking teeth 22*b* and the ledges 206*a*, 206*b* of the interlocking teeth 22*a* to engage each other to secure the core 12 in the cylindrical shape shown in FIG. 2B.

FIG. 2D shows an enlarged fragmentary view of the core showing another small portion of the main body 20 and one of the connecting tabs 24*a*. The tab 24*a* includes a stem 50 and a retainer 52. The stem 50 and retainer 52 are formed from the same material as the main body 20, and may suitably have the same thickness. Each tab 24*a* and tab 24*b* has the same structure. In this embodiment, the tabs 24*a*, 24*b*, teeth 22*a*, 22*b* and main body 20 are formed as a die-cutting single sheet of polyethylene.

Referring to FIG. 2D, the stem 50 has a stem width $W_S$ and a stem height. The stem 50 has a first end 50*a* that extends from the edge top end edge 23*a* of the main body 20 to the bottom 52*b* of the retainer 52. The retainer 52 in this embodiment is trapezoidal in shape, but can be any shape having at least a partially flat bottom 52*b* having the first width $W_B$, and sides 52*a* that converge inward to a top 52*c* having a second width $W_T$ that is less than the first width $W_B$. The first width is $W_B$ greater than the stem width $W_S$ as well.

Figure 3:
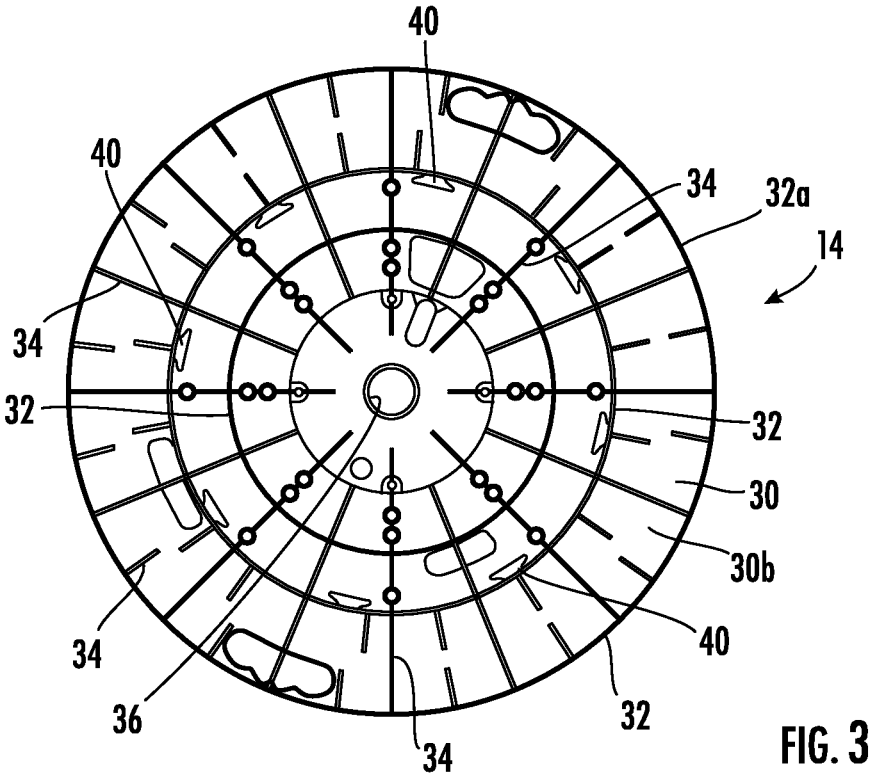
FIG. 3 shows a top plan view of an exemplary embodiment of a flange of the reel of FIG. 1.
Figure 4:
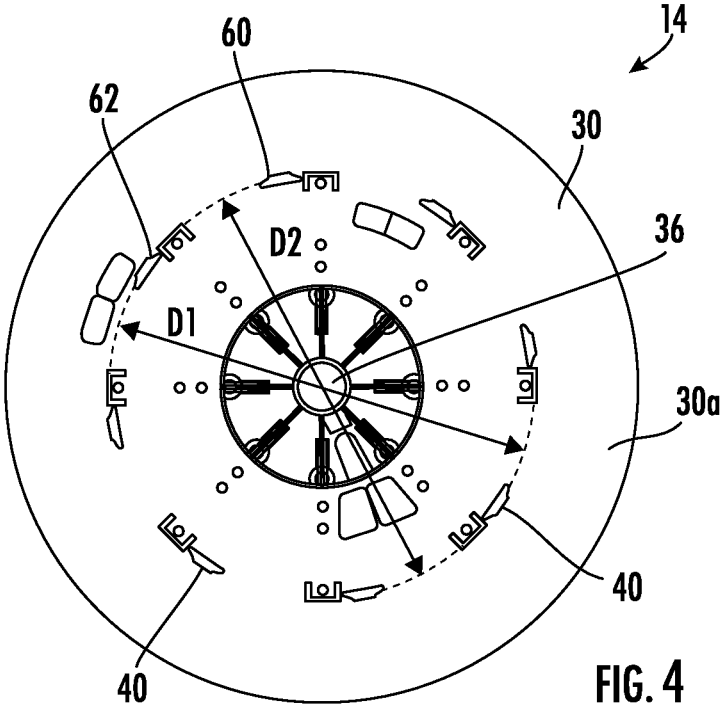
FIG. 4 shows a bottom plan view of the flange of FIG. 3.

FIG. 3 shows a top plan view of an exemplary embodiment of the flange 14. FIG. 4 shows a bottom plan view of the flange 14. The flange includes an annulus plate 30 and a plurality of rims 32 and ribs 34, which may take a variety of configurations. The annulus plate 30 includes a central arbor hole 36. In general, at least one and preferably more rims 32 are annular rims, including a rim 32*a* at or near the radially outer edge of the annulus, others surrounding the central arbor hole 36 that are radially inward of the outer rim 32*a*. The ribs 34 extend radially or otherwise between rims 32 and in some cases other features formed on the annulus 30.

In this embodiment, the annulus 30 has a first or inner side 30*a* (FIG. 4), and a second or outer side 30*b* (FIG. 3). The annulus 30 includes a plurality of shaped receptacles or openings 40 disposed between the arbor hole 36 and the outermost rim 32*a*. The openings 40 are spaced apart from each other, and are arranged in an annular configuration. The openings 40 extend through the annulus 30 from the first side 30*a* to the second side 30*b*. Each of the openings 40 is configured shaped to receive a connecting tab 24*a*/24*b*, such that at least one portion of the connecting tab 24*a*/24*b* extends through and stands proud of the opening 30. Specifically, when the core 12 is assembled into a cylindrical shape, and one edge of the core 12 is disposed against the first side 30*a* of the flange 14, a least a portion of the connecting tab 24*a*/24*b* is exterior to the opening 40 and adjacent the second side 30*a*.

Preferably, the connecting tabs 24*a*/24*b* and openings 40 are cooperatively configured to inhibit de-insertion of each connecting tab 24*a*/24*b* from its corresponding opening 40, so as to keep the reel 10 assembled. To this end, the connecting tab 24*a*/24*b* in this embodiment is designed to elastically deform to allow insertion through the opening 40, and then spring or snap back such that elements of the connecting tab 24*a*/24*b* do not align with the opening 40, once the elastic deforming force is released.

Figure 5:
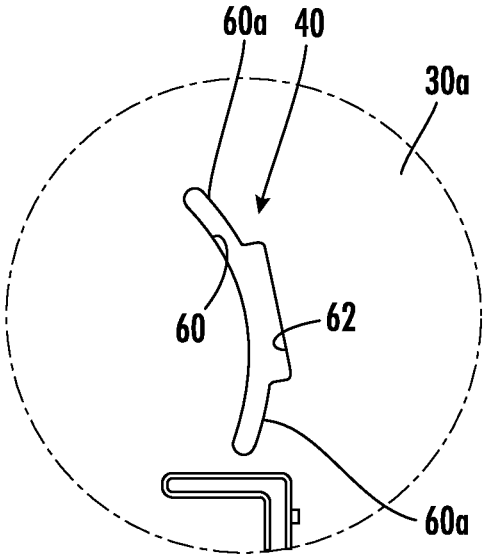
FIG. 5 shows a fragmentary view of a first side of the flange including a single opening for receiving a connecting tab of the core of FIGS. 2A and 2B.

FIG. 5 shows a fragmentary view of the first side 30*a* of the annulus 30 including a single opening 40 for receiving the tab 24*a*. Referring to FIG. 5, the opening 40 has a shape defined by a crescent 60 and a base 62. The base 62 is located in the center of the convex side of the crescent 60 and is shorter than the crescent. The base 62 in this embodiment is rectangular. The crescent 60 has a thickness along its length that is slightly larger than the thickness of the tab 24*a*. Because the crescent 60 and base 62 form a continuous opening 40, the portion of the opening 40 where the base 62 and crescent 60 are together is significantly thicker than the thickness of the tab 24*a*.

With reference again to FIGS. 3 and 4 the bases 62 of the receptacles or openings 40 are arranged in a substantially circular pattern having a first diameter $D_1$, and crescents 60, which are radially inward of the bases 62, are arranged in a substantially circular pattern having a second diameter $D_2$ that is less than the first diameter $D_1$. It will be appreciated that when the main body 20 is deformed or rolled into the cylinder as shown in FIG. 2B, the connecting tabs 24*a* and 24*b* are arranged similarly in a substantially circular pattern having a third diameter $D_3$ that is greater than the second diameter $D_2$, and which may be same as or greater than $D_1$.

In assembly of the rolled core 12 of FIG. 2B onto the flanges, each tab 24*a* is inserted into the crescent 60. Because $D_3$ is greater than $D_2$, the angled sides 52*b* of the retainer 52 interact with the sides of the base 62 to force the retainer to flex or elastically deform inward toward the crescent 60. Also, the angled sides 52*b* of the retainer interact with the curved wings 60*a* of the crescent 60 for further deformation as the tab 24*a* is advanced into to the crescent 60. This interaction causes the angled sides 52*a* of the retainer 52 to elastically deform inward, gradually adopting the shape of the crescent 60. This action also can flex all or part of the stem 50 inward as well. Note that the stem 50 and retainer 52 can also have some flexing due to the bending the main body 20 to create the tube/cylinder shape. Once the entire retainer 52 passes through the opening 40, the angled sides 52*a* of the retainer 52 clear the annulus 30 and can release from the flexing, and revert to their prior shape, because the wings 60*a* of the crescent 60 no longer engage the angled sides 52*a*. The stem 50 may also release further into being seated in the base 62 of the opening 40.

In such a position, the stem 50 is disposed within the opening 40, and the retainer 52 is on the second side 14*a* of the flange 14, opposite the location of the main body 20. The angled sides 52*a* of the retainer 52, without the pressure 52*a* of the wings of the crescent 60, are in a position that does not align with the crescent 60. As such the retainer 52 is locked into position on the second (external) side 14*b* of the flange 14 while edge of the main body 20 is against the first (inner) side 14*a* of the flange 14.

All of the connecting tabs 24*a*, 24*b* may be inserted into corresponding openings 40 in the flanges 14 in the same manner to complete the assembly of the reel 10. Accordingly, it will be appreciated that the location of the openings 40 on the flanges 14 are located in a manner that corresponds to the location of the connecting tabs 24*a*, 24*b*. Once the tabs 24*a*, 24*b* are all coupled into corresponding openings in opposing flanges 14, the reel 10 can be used to wind flexible media, such as cable, wire, optical fiber, and other windable material.

Referring to FIGS. 2A, 3 and 4, the reel 10 may be provided as a kit comprising two flanges 14 and the core blank 12*a*, which can then be assembled into the reel 10 of FIG. 1 as described above at another location, such as where the wound flexible media is loaded onto the reel 10. This allows for reduced cost shipping because empty assembled reels do not need to be shipped to the location where the wound flexible media is loaded. In some cases where many reels are to be shipped, a plurality of flanges 14 for a plurality of reels 10 are shipped together on one or more substrates, such as ordinary shipping pallets, not shown, and a corresponding plurality of reel blanks 12*a* are shipped on another substrate or pallet, not shown.

Referring again to the reel 10 itself, in some cases, an additional coupling means may be used to supplement the axial retention force provided by the connecting tabs 24*a*, 24*b*. Such coupling means can include carriage bolts or other connectors, not shown, that connect to the two flanges 14, or an arrangement for stapling each flange 14 to parts of the core 12. It will be appreciated that any such supplemental coupling means would require less retention strength than that which would be necessary in a reel that did not include the connecting tabs 24*a*, 24*b* and openings 40 configured as discussed above.

It is noted that part of the de-insertion function is provided by the stem 50 being trapped or seated in the base 60, because of natural spring tension of the stem 50. The base 60 thus has a length approximately equal to the length of the stem 50, but shorter than the bottom 52*b* of the retainer 52. In practice, however, the stem 50 may not tightly fit lengthwise in the base 60, due to the flexing requirements for insertion or other factors. In such case, there is a possibility of slight rotation of the core 12 on the flanges 14. In other words, if the stem 50 has room to move laterally (i.e. circumferentially) within the base 60 of the opening, then the core 12 can slightly move in the same direction with respect to the flange 14. Such rotation generally decreases robustness.

Figure 6:
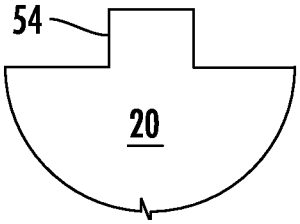
FIG. 6 shows a fragmentary plan view of a portion of an alternative embodiment of the main body of the core blank of FIG. 2A with an anti-rotation lug.

Accordingly, in one alternative embodiment, a number of the connecting tabs 24*a*, 24*b* may be replaced by anti-rotation tabs. For example, FIG. 6 shows a fragmentary plan view of a portion of the main body 20 of the core 12 with an anti-rotation lug 54. The anti-rotation lug 54 may suitably be a rectangular tab that extends outward from the main body 20 similar to, and among the connecting tabs 24*a*, 24*b*. However, the anti-rotation tabs 54 have a width that more tightly fits either the base 60 (or in other embodiments the entire crescent 62) of the opening to substantially inhibit any rotational movement of the core 12 with respect to the flange 14, even if the stem 50 has room to move circumferentially within the opening 40. In this embodiment, the core 12 may suitably have four or more connecting tabs 24*a* and two or more anti-rotation lugs 54 on one edge, and a similar number of connecting tabs 24*b* and anti-rotation lugs 54 on the opposite edge. Referring to FIG. 2A, for example, two of the connecting tabs 24*a* are replaced by the anti-rotation lugs 54, and two of the connecting tabs 24*b* are replaced by the anti-rotation lugs 54. Of course, additional numbers of connecting tabs 24*a*, 24*b* and/or anti-rotation lugs may be used.

Figure 7:
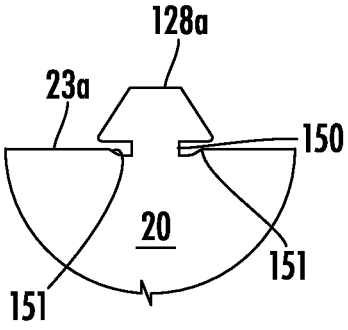
FIG. 7 shows a first alternative connecting tab of an alternative of the core blank of FIG. 2A.

In addition, it will be appreciated that other connection arrangements of connecting tabs and corresponding openings may be used. For example, FIG. 7 shows a first alternative connecting tab 124*a* having a longer stem 150 created by an indentation 151 in the first end edge 23*a* of main body 20 adjacent to the stem 150. This design increases the flexibility for insertion, which can further inhibit de-insertion from the opening 40 because of a greater spring action. In such an embodiment, the main body 20 of the core 12 would include connecting tabs 124*a* on opposite sides to replace the connecting tabs 24*a*, 24*b*. Such a design would preferably incorporate two or more anti-rotation lugs 54 interspersed with the connecting tabs 124*a* in the manner discussed above.

Figure 8A:
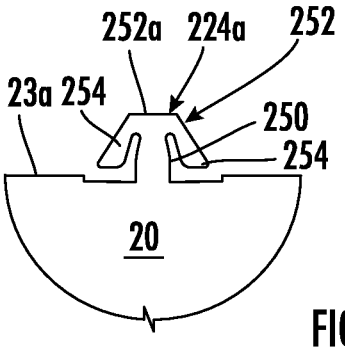
FIG. 8A shows a second alternative connecting tab of an alternative of the core blank of FIG. 2A.
Figure 8B:
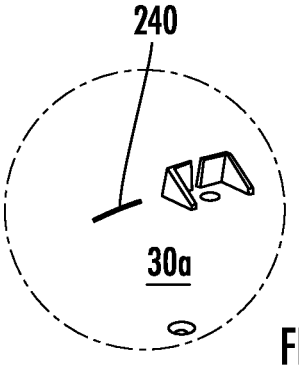
FIG. 8B shows a fragmentary view of a flange with an alternative embodiment of an opening for use with the second alternative connecting tab of FIG. 8A.

FIG. 8A shows a second alternative connecting tab 224*a* having a longer stem 250, as well a retainer 252 formed by wings 254 that extend downward and outward from the top 252*a*. FIG. 8B shows an alternative embodiment of the opening 240, which replaces the openings 40 in the flanges 14 for use with the connecting tabs 224*a*. The wings 254 allow lateral flexing (i.e. in the circumferential direction) so that the wings 254 flex (under spring pressure) laterally to fit through the opening 240, which is shorter than the longest span of the wings 254. Once the wings clear the opening 240, they spring back outward and engage the second (outer) side 30*b* of the annulus 30, and are trap fit in position.

In such an embodiment, the main body 20 of the core 12 would include connecting tabs 224*a* on opposite sides to replace the connecting tabs 24*a*, 24*b*, and the flanges 14 would include openings 240 to replace the openings 40. Such a design would preferably incorporate two or more anti-rotation lugs 54 interspersed among the annular configuration of the connecting tabs 224*a*.

In some embodiments, the reel 10 further includes clips or other fasteners that are configured to secure the connecting tabs to a feature on the outer side 30*b* of the annulus 30.

Figure 9A:
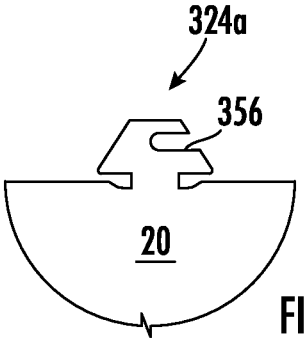
FIG. 9A shows a third alternative connecting tab of an alternative of the core blank of FIG. 2A.
Figure 9B:
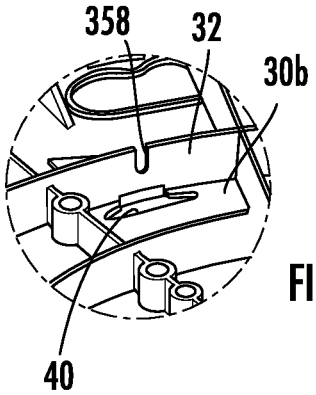
FIG. 9B shows a fragmentary view of a flange with another alternative embodiment of an opening for use with the third alternative connecting tab of FIG. 9A.

By way of example, FIG. 9A shows an alternative embodiment of the connecting tab 324 which is similar to the connecting tab 124*a* of FIG. 7, except that the retainer 352 includes a side slot 356 for receiving a clip, not shown, but see FIG. 9C discussed further below. FIG. 9B shows an alternative embodiment of the flange 14 wherein a rim 32 (or other structure, such as a rib 34) on the outer side 30*b* of the annulus 30*a* has a corresponding slot 358. In this embodiment, once the retainer 352 clears the opening 40, the portions slots 356 and 358 are in alignment, forming a through-hole.

In that position, a suitable fastener, such as a clip, rivet, bolt, staple, or adhesive, is assembled onto the reel 10 through the slots 356, 358, which helps inhibit de-insertion of the retainer 352 through the opening 40. FIG. 9C shows a non-limiting example of the style of clip 360, which may suitably be a plastic rivet or automotive fastener. It will be appreciated that precise clip or fastener design can be readily selected to suit the use described above.

Figure 9C:
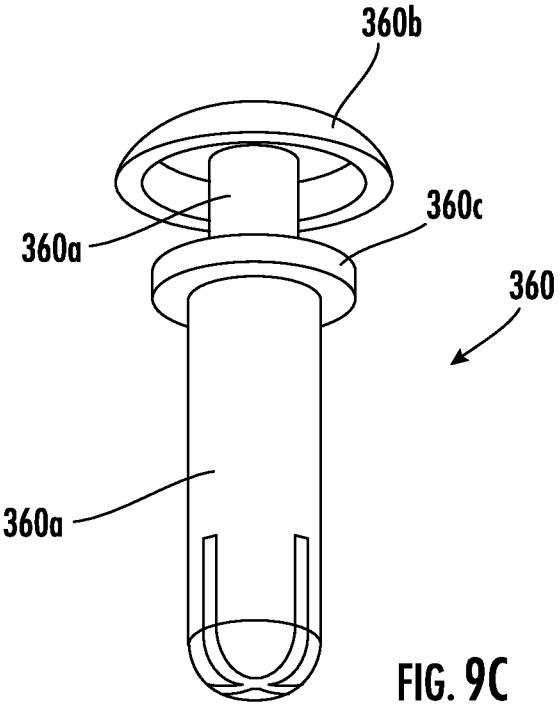
FIG. 9C shows a non-limiting example of a clip for securing the third alternative connecting tab of FIG. 9A.

In the embodiment of FIG. 9C, the clip 360 includes a shaft 360*a*, a first head 360*b* disposed on an end of the shaft 360*a*, and a second head 360*c* disposed in an intermediate position on the shaft 360*a*. As discussed above, the portions slots 356 and 358 of FIGS. 9A and 9B are in alignment, forming a through-hole. The second head 360*c* is forced through the through-hole formed by slots 356, 358. The heads 360*b*, 360*c* prevent de-insertion of the shaft 360*a*, which in turn prevents de-insertion of the retainer 352 through the opening 40.

Although the clip 360 helps inhibit de-insertion, the retainer 352 and opening 40 are nevertheless designed to have the same spring action retention feature of that of the design of FIG. 7.

In this embodiment, the main body 20 of the core 12 would include connecting tabs 324*a* on opposite sides to replace the connecting tabs 24*a*, 24*b*, and the flanges 14 would include slots 358 in certain of the rims 32 or other structures (such as ribs 34) that are adjacent to the openings 40. Such a design would preferably incorporate two or more anti-rotation lugs 54 interspersed with the connecting tabs 224*a*.

Figure 10A:
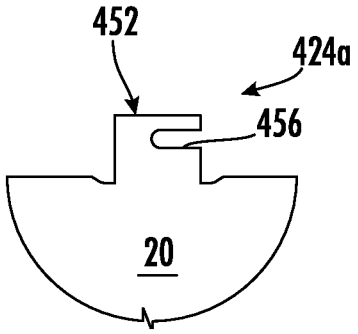
FIG. 10A shows a fourth alternative connecting tab of an alternative of the core blank of FIG. 2A.
Figure 10B:
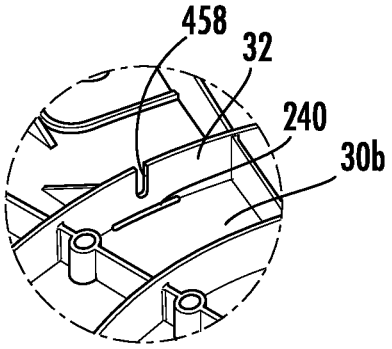
FIG. 10B shows a fragmentary view of a flange with another alternative embodiment of an opening for use with the fourth alternative connecting tab of FIG. 9A.

FIG. 10A shows another alternative embodiment that employs a clip. In this embodiment, the connecting tab 424*a* includes a retainer 452 that is rectangular, and does not include a stem. The retainer includes a side slot 456 similar to the slot 356. In this embodiment, the flanges 14 may suitably include openings 240 as shown in FIG. 8B. FIG. 10B shows the openings 240 as they appear on the outer or second side 30*b* of the annulus 30 of the flange 14. As also shown in FIG. 10B, a rim 32 (or other structure) on the side 30*b* of the annulus 30*a* has a corresponding slot 458, which has the same design and relative location as the slot 358 of FIG. 9B. In this embodiment, once the retainer 452 clears the opening 240, the slots 456 and 458 are in alignment. In that position, the clip 360 is assembled onto the reel 10 through the slots 456, 458, and inhibits de-insertion of the retainer 452 through the opening 240.

In such an embodiment, the main body 20 of the core 12 would include connecting tabs 424*a* on opposite sides to replace the connecting tabs 24*a*, 24*b*, and the flanges 14 would include openings 240 in place of the openings 40. The flanges 14 also include slots 458 in certain of the rims 32 or other structures adjacent to the openings 240. Such a design would not require anti-rotation lugs 54 because the rectangular shape of the retainer 452 can be designed to have a relatively tight fit within the opening 240.

It will be appreciated that in the embodiments of FIGS. 3 through 10B, the connecting tabs 24*a*, 24*b*, 124*a*, 224*a*, 324*a*, and 424*a* can have an axial height designed to extend further than an adjacent annular rim 32, for example, by approximately 1.5 mm to 4 mm, to act as a stacking and retention feature. In particular, once assembled and loaded with cable, wire, or the like, it is not unusual to ship and store reels stacked upon each other. Thus, in the case of stacking reels having the design of the reel 10, the flanges 14 would face each other, and typically the rest rim 32 (and/or rib 34) to rim 32 (and/or rib 34). If the connecting tab 24*a*, 24*b* etc. has an increased height as described above, the tab 24*a*, 24*b* etc. can extend down past the top of the adjacent rim of the adjacent reel. The connecting tab 24*a*, 24*b* etc. can then prevent or inhibit lateral relative movement of the stacked reels.

Referring again to FIG. 2A, it will be appreciated that the unrolled core 12 or blank 12*a* can be shipped more efficiently than the prior art cylindrical core because of the reduction in space consumed by the unrolled core 12. The interlocking teeth 22*a*, 22*b* provide a convenient means to connect the ends once the core 12 is rolled. It will be appreciated that the core 12 can vary in axial height or diameter by changing the corresponding dimension of the main body 20. In addition, the connection means may take other forms.

Figure 11:
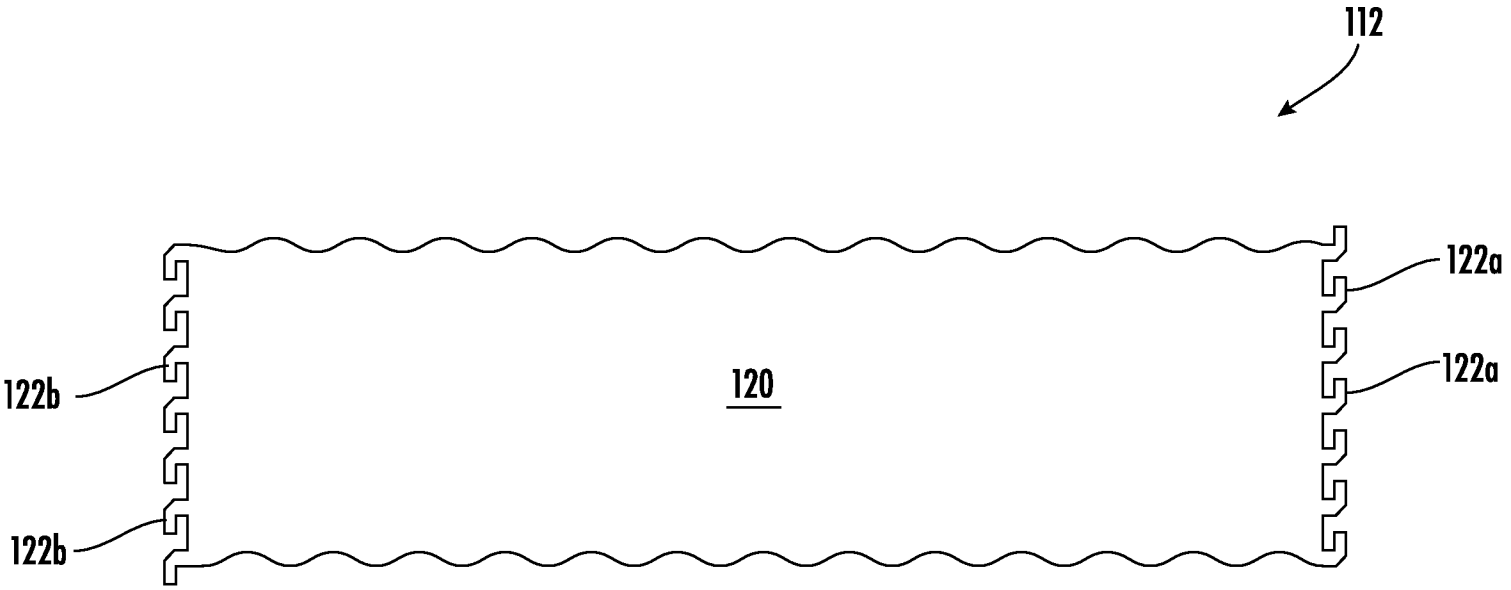
FIG. 11 shows a fragmentary top plan view of a first alternative core in its unrolled state.

For example, FIG. 11 shows a fragmentary top plan view of an alternative core 112 in its unrolled state. The core 112 includes a substantially rectangular main body 120, and interlocking teeth 122*a*, 122*b* that extend from opposite longitudinal ends of the main body 120. The interlocking teeth 122*a*, 122*b* in this embodiment are L-shaped extensions that extend respectively in opposite directions. The core 112 also includes connecting tabs located in a similar manner as those of the core 12 of FIG. 2. However, the connecting tabs are not shown in FIG. 11 because the fragmentary view is taken from the vertical midportion of the core 112. The connecting tabs may take any of the formats described above in connection with FIGS. 3 to 10. The main body 120 is configured to be deformed or rolled into a cylinder in which the interlocking teeth 122*a*, 122*b* engage each other to secure the ends to each other.

Figure 12B:
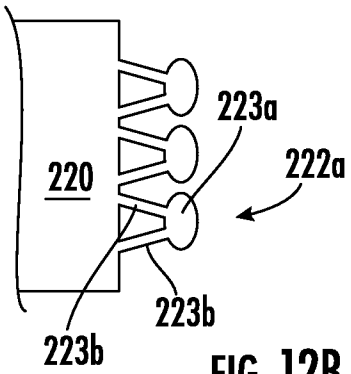
FIG. 12B shows a fragmentary top plan view of the core of FIG. 12A enlarged to show further detail of buttons of the core.
Figure 12A:
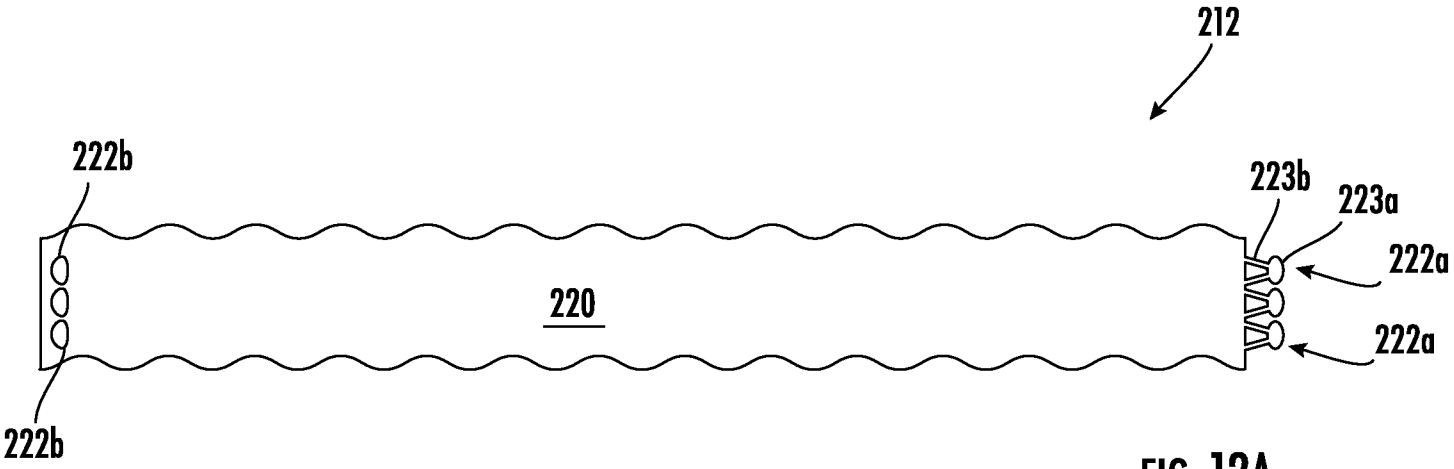
FIG. 12A shows a fragmentary top plan view of a second alternative core in its unrolled state.

In other example, FIG. 12A shows a fragmentary top plan view of an alternative core 212 in its unrolled state. The core 212 includes a substantially rectangular main body 220, a form of teeth or buttons 222*a* that extend from one longitudinal end of the main body 220, and buttonholes 222*b* disposed at the other longitudinal end of the main body 220.

FIG. 12B shows a fragmentary top plan view of the core 212 enlarged to show further detail of the buttons 222*a*.

With reference to FIGS. 12A and 12B, the teeth or buttons 222*a* in this embodiment are plastic oval plates 223*a* coupled to the main body 220 by two plastic legs 223*b*. The buttonholes 222*b* are through-holes having at least one dimension smaller (e.g. the height with respect to the axial direction of the core 112) than that of the plastic oval plate 223*b* of the button 222*a*. The oval plates 223*a*, legs 223*b*, and the main body 220 around the buttonhole 222*b* have sufficient elastic flexibility to allow the oval plate 223*a* to pass through the buttonhole 222*b*. Once external force is removed, the oval plate 223*a* and buttonhole 222*b* revert to their nominal sizes and the oval plate 223*a* is larger and cannot pass through the buttonhole 222*b*. By connecting all the buttons 222*a* with the buttonholes 222*b*, the core 212 is retained in its rolled, cylindrical form.

The core 212 also includes connecting tabs located in a similar manner as those of the core 12 of FIG. 2. However, the connecting tabs are not shown in FIG. 12A because the fragmentary view is taken from the vertical midportion of the core 212. The connecting tabs may take any of the formats described above in connection with FIGS. 3 to 10.

Figure 13A:
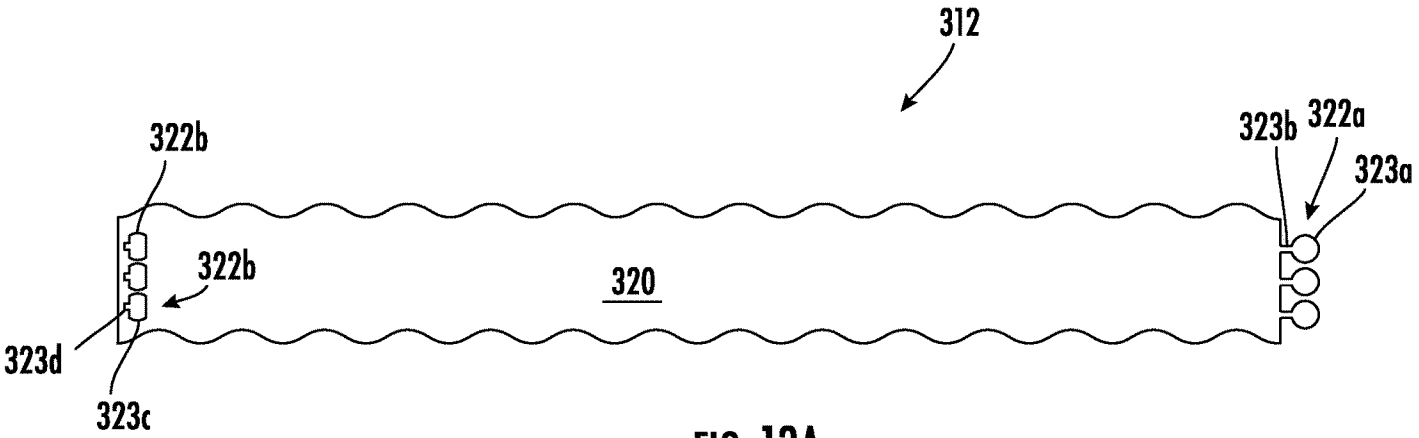
FIG. 13A shows a fragmentary top plan view of a third alternative core in its unrolled state.

In yet other example, FIG. 13A shows a fragmentary top plan view of an alternative core 312 in its unrolled state. The core 312 includes a substantially rectangular main body 320, teeth or buttons 322*a* that extend from one longitudinal end of the main body 320, and buttonholes 322*b* disposed at the other longitudinal end of the main body 320. FIG. 13B shows a fragmentary top plan view of the core 312 enlarged to show further detail of the buttonholes 322*b*. FIG. 13B shows another fragmentary top plan view of the core 312 enlarged to show further detail of the buttons 322*a*.

Figure 13C:
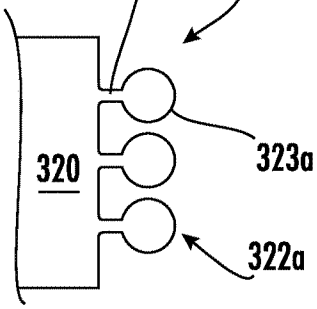
FIG. 13C shows a fragmentary top plan view of the core of FIG. 13A enlarged to show further detail of buttons of the core.
Figure 13B:
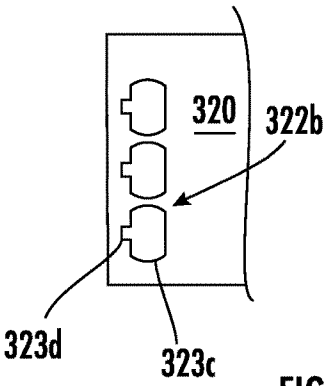
FIG. 13B shows a fragmentary top plan view of the core of FIG. 13A enlarged to show further detail of buttonholes of the core.

With contemporaneous reference to FIGS. 13A, 13B, and 13C, the buttons 322*a* in this embodiment are plastic oval or circular plates 323*a* coupled to the main body 320 by a plastic stem 323*b*. The buttonholes 322*b* are through-holes having an insertion portion 323*c* and a retention portion 323*d*. The insertion portion 323*c* has a height (e.g. the height with respect to the axial direction of the core 112) slightly larger than the height of the plate 323*a*. The retention portion 323*d* has a height slightly larger than the height of the stem 323*b*, but smaller than the height of the plate 323. To assemble the core 312, the plates 323*a* are passed through the insertion portions 323*c*. Because the main body 320 is biased to return to being flat, releasing the rolling force will case the main body 320 to start to unroll. As it does, the stem 323*b* will pass through the retention portion 323*d*, but the plate 323*a* will not because it is too large. By connecting all the buttons 322*a* with the buttonholes 322*b*, the core 312 is retained in its rolled, cylindrical form.

The core 312 also includes connecting tabs located in a similar manner as those of the core 12 of FIG. 2. However, the connecting tabs are not shown in FIG. 13 because the fragmentary view is taken from the vertical midportion of the core 312. The connecting tabs may take any of the formats described above in connection with FIGS. 3 to 10.

Figure 14:
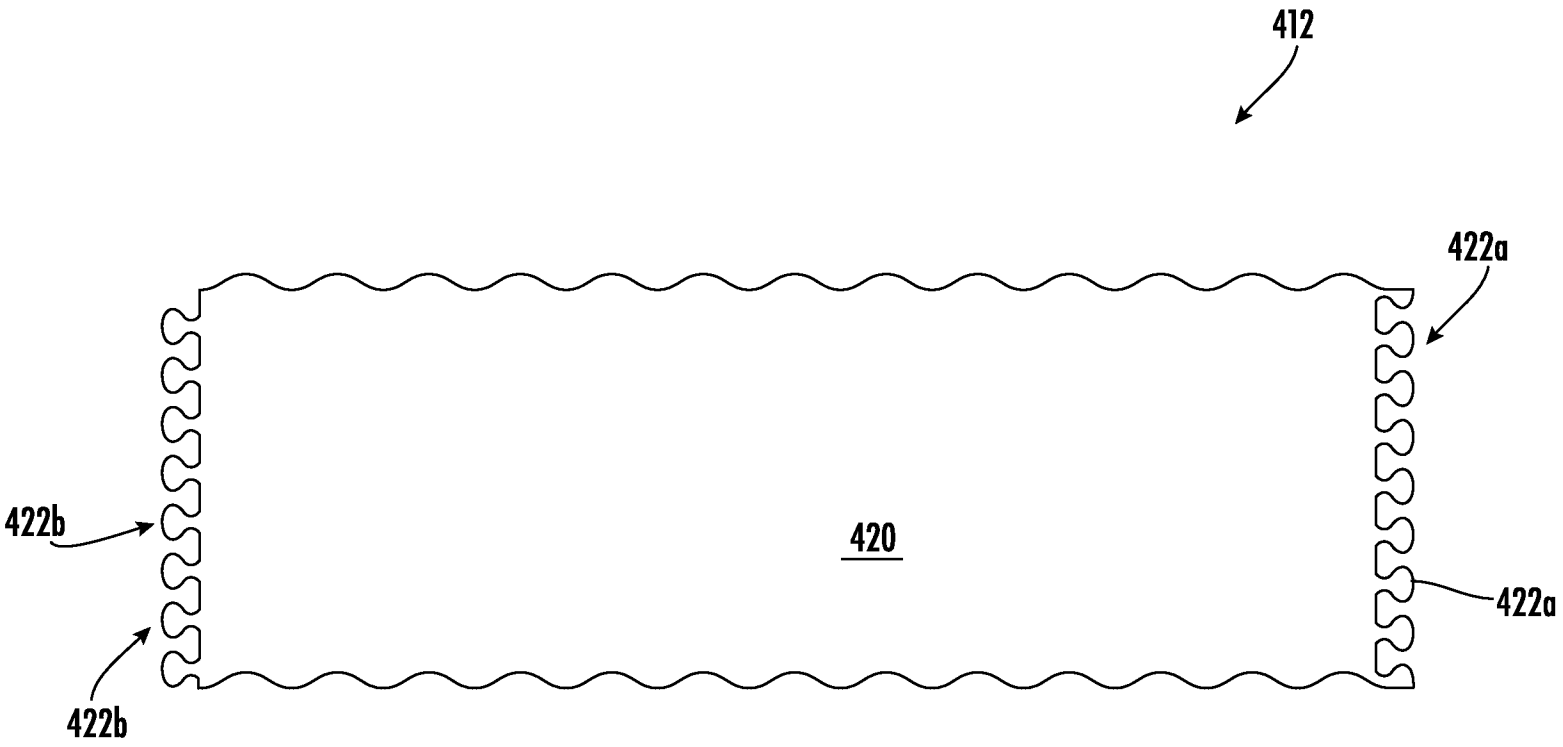
FIG. 14 shows a fragmentary top plan view of a fourth alternative core in its unrolled state.

FIG. 14 shows a fragmentary top plan view of an alternative core 412 in its unrolled state. The core 412 includes a substantially rectangular main body 420, and interlocking teeth 422*a*, 422*b* that extend from opposite longitudinal ends of the main body 120. The interlocking teeth 422*a*, 422*b* in this embodiment are tree-shaped extensions that extend respectively in opposite directions. The core 412 also includes connecting tabs located in a similar manner as those of the core 12 of FIG. 2. However, the connecting tabs are not shown in FIG. 114 because the fragmentary view is taken from the vertical midportion of the core 412. The connecting tabs may take any of the formats described above in connection with FIGS. 3 to 10. The main body 420 is configured to be deformed or rolled into a cylinder in which the interlocking teeth 422*a*, 422*b* engage each other to secure the ends to each other.

It will be appreciated that the above-described embodiments are merely illustrative, and that those of ordinary skill in the art may readily devise their own implementations and modifications that incorporation the principles of the present invention and fall within the spirit and scope thereof.

What is claimed is:

1. A kit configured for assembly into at least a first reel, the kit comprising:

a core having a substantially rectangular main body having opposing first and second axially extending edges and opposing first and second end edges extending between the first and second axially extending edges, a first set of interlocking teeth on the first axially extending edge, a first set of first connecting tabs on the first end edge, the main body configured to be deformed or rolled into a cylinder in which the first set of interlocking teeth engage connecting features of the second axially extending edge;

a first flange having an annulus and at least one axially extending-rib or rim, the annulus including receptacles for receiving and operably coupling to the first set of connecting tabs to axially retain a first side of the annulus on the core while an end point of each of the first set of connecting tabs stands proud of a second side of the annulus; and a second flange configured to couple to the core when the main body is rolled into a cylinder.

2. The kit of claim 1, further comprising a plurality of other cores, each other core having a substantially rectangular main body having opposing first and second axially extending edges and opposing first and second end edges extending between the first and second axially extending edges, a first set of interlocking teeth on the first axially extending edge, a first set of first connecting tabs on the first end edge, the main body configured to be deformed or rolled into a cylinder in which the first set of interlocking teeth engage connecting features of the second axially extending edge;

a plurality of other first flanges, each other first flange having an annulus and at least one axially extending rib or rim, and including receptacles for receiving and operable coupling to the first set of connecting tabs of one of the other cores; and a plurality of second flanges configured to couple to one of the other cores when the one of the other cores is rolled into a cylinder.

3. The kit of claim 2, wherein the core and plurality of other cores are disposed on first shipping substrate, and the first flange and the plurality of other first flanges are disposed on a second shipping substrate.

4. The kit of claim 1, wherein each of the connecting tabs includes a stem having a first end connected to main body, and a second end, and a retainer disposed at the second end of the stem, the retainer having a width greater than a greatest width of the stem.

5. The kit of claim 4, wherein a first side of the retainer is coupled to the second end of the stem, and a second side that disposed further from the main body than the first side, and wherein the first side has a width that is greater than the second side to facilitate insertion into a corresponding one of the receptacles.

6. The kit of claim 4, wherein the first end edge includes a plurality of recessed areas thar are recessed from other areas of the first end edge, and wherein the stem of each connecting tab is coupled to the first end edge in a corresponding one of the recessed areas.

7. The kit of claim 4, wherein:

each of the receptacles of the first flange has a base having a first width, and an interior portion having a second width that is less than the first width;

the bases of the receptacles are arranged in a substantially circular pattern having a first diameter;

the interior portions of the receptacles are arranged in a substantially circular pattern having a second diameter that is less than the first diameter;

when the main body is deformed or rolled into the cylinder in which the first set of interlocking teeth engage the connecting features, the connecting tabs are arranged in a substantially circular pattern having a third diameter that is greater than the second diameter.

8. The kit of claim 7, wherein the width of each retainer is greater than the first width of the base.

9. The kit of claim 8, wherein the stem of each connecting tab is elastically deformable.

10. The kit of claim 8, wherein the interior portions have an arcuate shape.

11. The kit of claim 1, further comprising at least a first fastener clip configured to secure a first connecting tab to the rim or rib of the first flange.

12. The kit of claim 11, wherein the first clip includes a slot configured to align with a corresponding opening in the rim or rib of the first flange, and wherein the first clip is configured to extend through the slot and the corresponding opening to secure first connecting tab to the rim or rib of the first flange.

13. The kit of claim 1, wherein the connecting features of the second axially extending edge comprises a second set of interlocking teeth.

14. A reel for retaining wound flexible media, comprising:

a core having a substantially rectangular main body having opposing first and second axially extending edges and opposing first and second end edges extending between the first and second axially extending edges, a first set of interlocking teeth on the first axially extending edge, a first set of first connecting tabs on the first end edge, the main body configured to be deformed or rolled into a cylinder in which the first set of interlocking teeth engage connecting features of the second axially extending edge;

a first flange having an annulus and at least one axially extending rib or rim, the annulus including receptacles for receiving and operably coupling to the first set of connecting tabs to axially retain a first side of the annulus on the core while an end point of each of the first set of connecting tabs stands proud of a second side of the annulus; and a second flange coupled to the core.

15. The reel of claim 14, wherein each of the connecting tabs includes a stem having a first end connected to main body, and a second end, and a retainer disposed at the second end of the stem, the retainer having a width greater than a greatest width of the stem.

16. The reel of claim 15, wherein:

each of the receptacles of the first flange has a base having a first width, and an interior portion having a second width that is less than the first width;

the bases of the receptacles are arranged in a substantially circular pattern having a first diameter;

the interior portions of the receptacles are arranged in a substantially circular pattern having a second diameter that is less than the first diameter;

when the main body is deformed or rolled into the cylinder in which the first set of interlocking teeth engage the connecting features of the second axially extending edge, the connecting tabs are arranged in a substantially circular pattern having a third diameter that is greater than the second diameter.

17. The reel of claim 16, wherein the width of each retainer is greater than the first width of the base.

18. The reel of claim 14, further comprising at least a first clip configured to secure a first connecting tab to the rim or rib of the first flange.

19. A reel for retaining wound flexible media, comprising:

a core having a substantially rectangular main body having opposing first and second axially extending edges and opposing first and second end edges extending between the first and second axially extending edges, a first set of interlocking teeth on the first axially extending edge, a first set of first connecting tabs on the first end edge, the main body configured to be deformed or rolled into a cylinder in which the first set of interlocking teeth engage connecting features of the second axially extending edge;

a first flange having an annulus and at least one rib or rim, the annulus including receptacles that receive and operably couple to the first set of connecting tabs such that at least a portion of the annulus disposed between the first end edge and at least one of the first set of connecting tabs; and a second flange coupled to the core.

* * * * *